US009765942B2

(12) United States Patent
Tsai et al.

(10) Patent No.: US 9,765,942 B2
(45) Date of Patent: Sep. 19, 2017

(54) LED LAMP AND OPTICAL LENS

(71) Applicant: KAISTAR Lighting (Xiamen) Co., Ltd, Xiamen (CN)

(72) Inventors: Sheng-Lung Tsai, Xiamen (CN); Jenn-Yuan Hsu, Xiamen (CN); Hsin-Yu Chiang, Xiamen (CN); Hsin-Ming Chiang, Xiamen (CN)

(73) Assignee: KAISTAR LIGHTING (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 15/182,628

(22) Filed: Jun. 15, 2016

(65) Prior Publication Data

US 2016/0290595 A1 Oct. 6, 2016

(30) Foreign Application Priority Data

Jul. 17, 2015 (CN) ..... 2015 1 0423018

(51) Int. Cl.

| | |
|---|---|
| ***F21V 5/00*** | (2015.01) |
| ***F21V 5/08*** | (2006.01) |
| ***F21V 5/04*** | (2006.01) |
| *F21Y 101/00* | (2016.01) |
| *F21Y 115/10* | (2016.01) |

(52) U.S. Cl.

CPC ..... *F21V 5/08* (2013.01); *F21V 5/045* (2013.01); *F21Y 2101/00* (2013.01); *F21Y 2115/10* (2016.08)

(58) Field of Classification Search

CPC . F21V 5/045; F21V 5/048; F21V 5/08; F21Y 2101/00; F21Y 2115/10

See application file for complete search history.

(56) References Cited

U.S. PATENT DOCUMENTS

| | | | | |
|---|---|---|---|---|
| 2007/0201225 | A1 | 8/2007 | Holder et al. | |
| 2011/0019425 | A1* | 1/2011 | Chen | F21V 5/04 362/311.02 |
| 2014/0265905 | A1* | 9/2014 | Ray | F21S 9/02 315/210 |
| 2014/0268802 | A1* | 9/2014 | Sun | F21V 5/04 362/294 |
| 2017/0023206 | A1* | 1/2017 | Tsai | F21V 5/045 |

FOREIGN PATENT DOCUMENTS

| | | |
|---|---|---|
| CN | 203115538 U | 8/2013 |

* cited by examiner

*Primary Examiner* — Ali Alavi
(74) *Attorney, Agent, or Firm* — Hemisphere Law, PLLC

(57) ABSTRACT

A LED lamp and an optical lens thereof are provided. The LED lamp includes a LED light source and an optical lens covering the LED light source. The optical lens includes a dome structure and a protrusion structure. The dome structure has an external surface. The protrusion structure is disposed protruding from the external surface and includes oppositely-disposed first and second side surfaces. The first side surface includes first and second optical surfaces. The second side surface includes a third optical surface. The second optical surface is connected immediately to the external surface and further connected between the external surface and the first optical surface. A boundary line of the second and the first optical surfaces is not disposed at the external surface. The third optical surface and the external surface are immediately connected. Accordingly, local uniformity of light distribution of the optical lens is improved.

10 Claims, 3 Drawing Sheets

LED LAMP AND OPTICAL LENS

FIELD OF THE INVENTION

The invention relates to the LED illumination technical field, and more particularly to a LED lamp and an optical lens.

BACKGROUND OF THE INVENTION

In recent years, a light emitting diode (LED) lamp has been undergoing a rapid growth and gradually stepping into the general illumination market. Compared with a conventional incandescent tungsten filament bulb and a fluorescent lamp, a LED lamp makes use of the superiority in small size, energy-saving, environment-friendly and long lifespan to achieve an appellation of green light source.

Referring to FIG. 1, a structural view of a related optical lens applied in a LED lamp. As shown in FIG. 1, an optical lens 10 includes a mounting pedestal/base 11, a dome structure 13 disposed on the mounting base 11, and a protrusion structure 15 outwardly protruding from the dome structure 13 along a direction away from the mounting base 11. The dome structure 13 has a first optical curved surface 131, the protrusion structure 15 has a second optical curved surface 151, and a boundary line of the second optical curved surface 151 and the first optical curved surface 131 is a horizontal line and disposed at an external surface (i.e., the first optical curved surface 131) of the dome structure 13.

Referring to FIG. 2, it is a light pattern simulation diagram of the optical lens 10 as shown in FIG. 1. As seen from FIG. 2, it can be found that a dark band appears in the middle of the light pattern and is marked by an oval dashed box, that is, a local uniformity of light distribution of the optical lens is poor.

SUMMARY OF THE INVENTION

Therefore, aiming at the insufficiency in the foregoing related art, the invention provides a LED lamp and an optical lens so as to solve the problem of uneven local light distribution of optical lens.

Specifically, an embodiment of the invention provides a LED lamp, including: a LED light source and an optical lens covering the LED light source. The optical lens includes a dome structure and a protrusion structure, the dome structure has an external surface, the protrusion structure is disposed protruding from the external surface of the dome structure with oppositely-disposed first side surface and second side surface. The first side surface includes a first optical surface and a second optical surface, the second side surface includes a third optical surface, the second optical surface is connected directly with the external surface and further connected between the external surface of the dome structure and the first optical surface, a boundary line of the second optical surface and the first optical surface is not disposed at the external surface of the dome structure, the third optical surface and the external surface of the dome structure are connected directly.

In an embodiment of the invention, the first side surface is an inwardly concave surface formed by the first optical surface and the second optical surface.

In an embodiment of the invention, the boundary line of the second optical surface and the first optical surface is a horizontal line disposed above the external surface of the dome structure.

In an embodiment of the invention, the first optical surface above is a flat surface, a curved surface or a combination of free-form surfaces.

In an embodiment of the invention, the second optical surface above is a flat surface and an intersection angle between the second optical surface and an imaginary vertical surface is θ, and θ is in a range of 0~60 degrees.

In an embodiment of the invention, the optical lens further includes a mounting base and a plurality of mounting holes defined on the mounting base, the dome structure is disposed on the mounting base.

Furthermore, an optical lens provided by an embodiment of the invention includes a dome structure and a protrusion structure, the dome structure has an external surface, the protrusion structure is disposed protruding from the external surface of the dome structure with a first side surface and a second side surface disposed opposite to each other. The first side surface contains a first optical surface and a second optical surface, the second side surface contains a third optical surface, the second optical surface is connected directly to the external surface and further connected between the external surface of the dome structure and the first optical surface, a boundary line of the second optical surface and the first optical surface is disposed above the external surface of the dome structure, the third optical surface and the external surface of the dome structure are connected directly.

In an embodiment of the invention, the first side surface of the optical lens is an inwardly concave surface formed by the first optical surface and the second optical surface.

In an embodiment of the invention, the boundary line of the second optical surface and the first optical surface of the optical lens is a horizontal line, and the first optical surface is a flat surface, a curved surface or a combination of free-form surfaces.

In an embodiment of the invention, the second optical surface of the optical lens is a flat surface and an intersection angle between the second optical surface and an imaginary vertical surface is θ, and θ is in range of 0~60 degrees.

Sum up, the embodiments of the invention introduce the second optical surface between the first optical surface of the optical lens and the external surface of the dome structure as a transition surface, which can improve local light distribution evenness of the optical lens.

By the following detailed description with reference to accompanying drawings, other aspects and features of the invention will become apparent. However, it should be understood that, the drawings only are for the purpose of explanation and not as limiting the scope of the invention, and the scope of the invention should refer to the appended claims. It also be appreciated that, unless otherwise indicated, the drawings are not necessarily drawn to scale, they are merely trying to conceptually illustrate the structures and procedures described herein.

BRIEF DESCRIPTION OF THE DRAWINGS

In the following, with reference to accompanying drawings, concrete embodiments of the invention will be described in detail. In the drawings.

DETAILED DESCRIPTION OF PREFERRED EMBODIMENTS

Embodiments of the invention are described in detail with reference to the accompanying drawings as follows to better understand the objectives, features and advantages of the invention.

Figure 3:
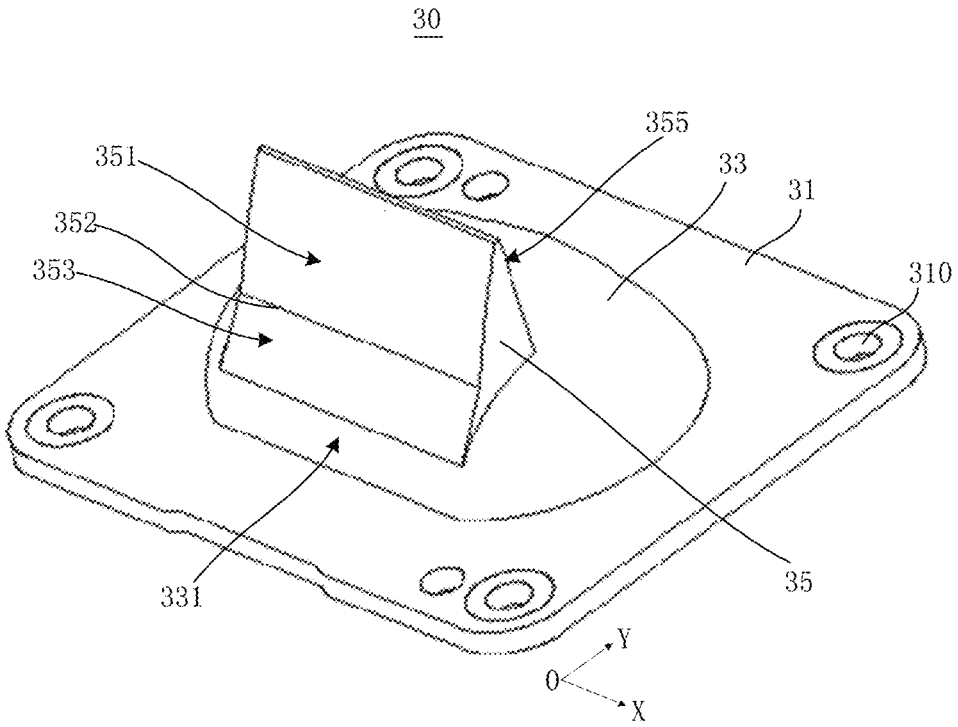
FIG. 3 is a structural diagram of an optical lens according to an embodiment of the invention.

Referring to FIG. 3, an optical lens 30 provided by an embodiment of the invention includes a mounting base 31, a dome structure 33 and a protrusion structure 35. A plurality of mounting holes 310 are defined on the mounting pedestal 31. The dome structure 33 is disposed on the mounting base 31 and has an external surface 331. Herein, the dome structure 33 and the mounting base 31 are an integrally-formed structure. The protrusion structure 35 is disposed outwardly protruding from the external surface 331 of the dome structure 33 and includes a first side surface and a second side surface. The first side surface is constituted by a first optical surface 351 and a second optical surface 353 to thereby form an inwardly concave surface; the second optical surface 353 is connected immediately with the external surface 331 of the dome structure 33 and further connected between the external surface 331 of the dome structure 33 and the first optical surface 351. One end of the first optical surface 351 is connected to the second optical surface 353 to form a boundary line 352 and the other end thereof is connected to the top surface of the protrusion structure 35 (not labelled in FIG. 3). The boundary line 352 of the first optical surface 351 and the second optical surface 353 is a horizontal line and disposed above the external surface 331 of the dome structure 33, which means that a non-zero distance exists between the boundary line 352 and the external surface 331 of the dome structure 33, or in other words, the boundary line 352 is not disposed at the external surface 331 of the dome structure 33. As shown in FIG. 3, the first optical surface 351 and the second optical surface 353 both are flat surfaces, but the invention is not limited to this, for example, the first optical surface 351 maybe a curved surface or a combination of free-form surfaces instead. The second side surface acts as a third optical surface 355, and the third optical surface 355 and external surface 331 of the dome structure 33 are connected directly. Moreover, the third optical surface 355 may be a flat surface, but the invention is not limited to this.

Figure 4:
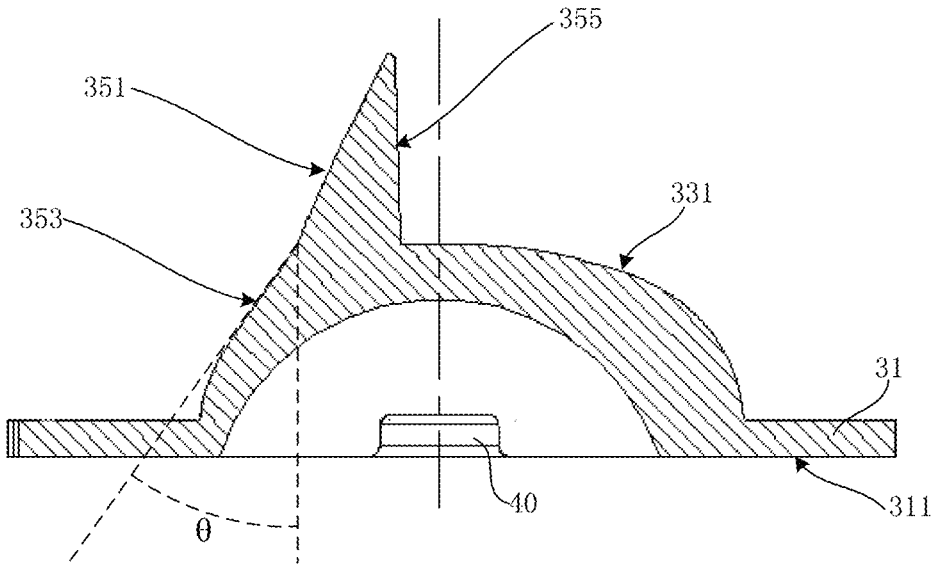
FIG. 4 is a cross-sectional view of the optical lens shown in FIG. 3 taken along Y axis, and the optical lens and a LED light source are combined to assemble a LED lamp.

Referring to FIG. 4 and FIG. 3 together, an intersection angle of the second optical surface 353 with respect to an imaginary vertical surface is θ, and a range of θ is 0~60 degrees, such as the angle θ is 35 degrees. Furthermore, it can be seen from FIG. 4, when a LED light source 40 and the optical lens are assembled together to form a LED lamp, the LED light source 40 is mounted in an inner accommodating space of the optical lens 30 and a bottom/lower surface 311 of the mounting base 31 is regarded as a light source installing surface. Typically, the LED light source 40 includes a chip on board (COB) substrate and one or more LED chips disposed on the COB substrate. Moreover, for facilitating heat-dissipating of the LED lamp, the COB substrate generally is disposed being thermally contacted with a heat sink, for example, the COB substrate is directly contacted with the heat sink or thermally connected with the heat sink via a thermally-conductive glue, and subsequently fasteners (such as screws) are used to penetrate through the mounting holes 310 defined on the mounting base 31 to achieve the optical lens 30 being mechanically connected with the heat sink.

Figure 5:
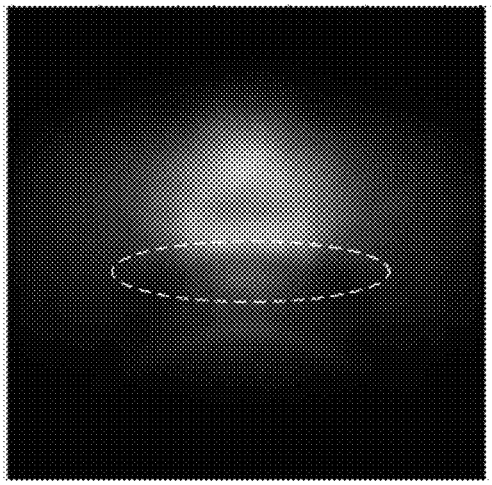
FIG. 5 is a light pattern simulation diagram of the optical lens shown in FIG. 3.

Referring to FIG. 5, it is a light pattern simulation diagram of the optical lens 30 as shown in FIG. 3. As seen from FIG. 5, it can be found that the dark band in the middle of the light pattern, as marked by an oval dashed box in FIG. 5, becomes almost invisible; that is, the light emitting evenness of the optical lens 30 has been improved.

Figure 1:
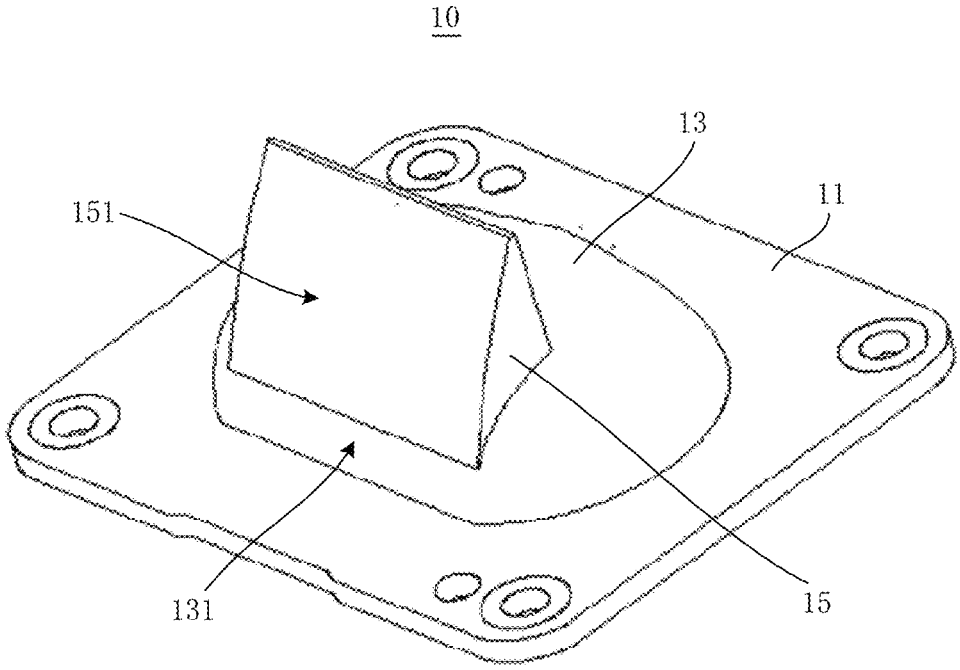
Fig. 1 (Related Art)
FIG. 1 is a structural diagram of a related optical lens applied in a LED lamp.
Figure 2:
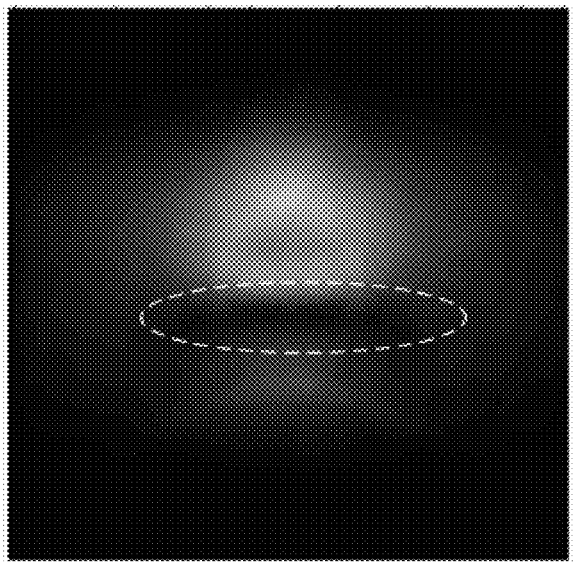
Fig. 2 (Related Art)
FIG. 2 is a light pattern simulation diagram of the optical lens shown in FIG. 1.
Figure 6:
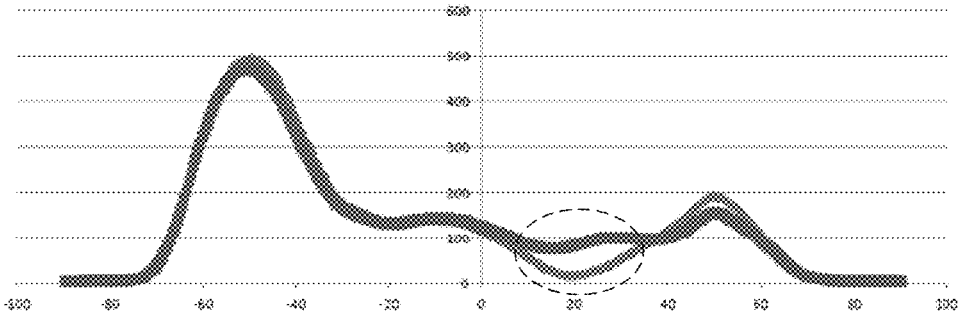
FIG. 6 is a comparison chart of luminous flux of optical lenses respectively shown in FIG. 1 and FIG. 3.

Referring to FIG. 6, a comparison chart of luminous flux of optical lens 10 shown in FIG. 1 and that of optical lens 30 shown in FIG. 3. In FIG. 6, the relatively fine line represents a luminous flux curve of the optical lens 10 shown in FIG. 1, the relatively heavy line represents a luminous flux curve of the optical lens 30 shown in FIG. 3. It can be found by comparing the two luminous flux curves, luminous flux of the dark band in the light pattern of the optical lens 30 shown in FIG. 3 increases obviously, so that the dark band becomes less conspicuous. Moreover, it also can be found from FIG. 6 that the luminous flux of right side of the vertical axis is much less than that of left side, which means that the optical lens 30 is an asymmetrical-light-emitting optical lens owning to the configuration of the protrusion structure 35, i.e., the optical lens 30 can achieve an asymmetrical light pattern.

In summary, the foregoing embodiments of the invention introduces the second optical surface 353 between the first optical surface 351 of the optical lens 30 and the external surface of the dome structure 33 as a transition surface, which can effectively improve local light distribution evenness of the optical lens 30. Furthermore, it can be understood that the optical lens 30 of the above-mentioned embodiment of the invention is not restricted to be assembled with the LED light source to achieve a LED lamp, and other light sources can be employed instead. In addition, the mounting base 31 is optional, and it is mainly for improving installation convenience of the optical lens 30.

The above description illustrates various exemplary embodiments to explain the principles and implementations of the LED lamp and the optical lens of the invention, and the foregoing exemplary embodiments only are used to help understand the solution of the invention and its core idea. For those skilled persons in the art, various modifications and variations can be made according to the concept of the invention, and therefore the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A LED lamp, comprising a LED light source and an optical lens covering the LED light source, the optical lens comprising a dome structure and a protrusion structure, the dome structure having an external surface, the protrusion structure being disposed protruding from the external surface of the dome structure;

wherein the protrusion structure comprises a first side surface and a second side surface disposed opposite to each other, the first side surface comprises a first optical surface and a second optical surface, the second side surface comprises a third optical surface, the second optical surface is connected immediately with the external surface and further connected between the external surface of the dome structure and the first optical surface, a boundary line of the second optical surface and the first optical surface is not disposed at the external surface of the dome structure, the third optical surface is connected immediately with the external surface of the dome structure.

2. The LED lamp according to claim 1, wherein the first side surface is an inwardly concave surface formed by the first optical surface and the second optical surface.

3. The LED lamp according to claim 2, wherein the boundary line of the second optical surface and the first optical surface is a horizontal line disposed above the external surface.

4. The LED lamp according to claim 2, wherein the first optical surface is a flat surface, a curved surface or a combination of free-form surfaces.

5. The LED lamp according to claim 2, wherein the second optical surface is a flat surface and an intersection angle between the second optical surface and an imaginary vertical surface is θ, and θ is in a range of 0~60 degrees.

6. The LED lamp according to claim 1, wherein the optical lens further comprises a mounting base and a plurality of mounting holes defined on the mounting base; the dome structure is disposed on the mounting base.

7. An optical lens, comprising a dome structure and a protrusion structure, the dome structure having an external surface, the protrusion structure being disposed protruding from the external surface of the dome structure;

wherein the protrusion structure comprises a first side surface and a second side surface disposed opposite to each other, the first side surface comprises a first optical surface and a second optical surface, the second side surface comprises a third optical surface, the second optical surface is connected immediately to the external surface and further connected between the external surface of the dome structure and the first optical surface, a boundary line of the second optical surface and the first optical surface is disposed above the external surface of the dome structure, the third optical surface and the external surface of the dome structure are immediately connected with each other.

8. The optical lens according to claim 7, wherein the first side surface is an inwardly concave surface formed by the first optical surface and the second optical surface.

9. The optical lens according to claim 8, wherein the boundary line of the second optical surface and the first optical surface is a horizontal line, and the first optical surface is a flat surface, a curved surface or a combination of free-form surfaces.

10. The optical lens according to claim 8, wherein the second optical surface is a flat surface and an intersection angle between the second optical surface and an imaginary vertical surface is θ, and θ is in a range of 0~60 degrees.

* * * * *